US010750854B2

(12) United States Patent
Egger

(10) Patent No.: US 10,750,854 B2
(45) Date of Patent: Aug. 25, 2020

(54) ELECTRICALLY HEIGHT-ADJUSTABLE TABLE

(71) Applicant: YAASA Living AG, St. Gallen (CH)

(72) Inventor: Stephan Egger, Speicher (CH)

(73) Assignee: YAASA LIVING AG, St. Gallen (CH)

( * ) Notice: Subject to any disclaimer, the term of this patent is extended or adjusted under 35 U.S.C. 154(b) by 0 days.

(21) Appl. No.: 16/396,500

(22) Filed: Apr. 26, 2019

(65) Prior Publication Data

US 2019/0328130 A1 Oct. 31, 2019

(30) Foreign Application Priority Data

Apr. 27, 2018 (DE) ..... 10 2018 110 261

(51) Int. Cl.

| | |
|---|---|
| ***A47B 21/02*** | (2006.01) |
| ***A47B 9/20*** | (2006.01) |
| ***A47B 13/02*** | (2006.01) |
| ***A47B 13/08*** | (2006.01) |

(52) U.S. Cl.

CPC ..... *A47B 21/02* (2013.01); *A47B 9/20* (2013.01); *A47B 13/02* (2013.01); *A47B 13/08* (2013.01); *A47B 2200/0051* (2013.01); *A47B 2200/0059* (2013.01); *A47B 2200/0062* (2013.01)

(58) Field of Classification Search

CPC ..... A47B 21/02; A47B 9/20; A47B 13/02; A47B 13/08; A47B 2200/0051; A47B 2200/0059; A47B 2200/0062

USPC ..... 108/51.3, 144.11, 147, 116, 115

See application file for complete search history.

(56) References Cited

U.S. PATENT DOCUMENTS

| | | | | |
|---|---|---|---|---|
| 3,080,835 A * | 3/1963 | Guglielmi | A47B 9/10 | 108/116 |
| 3,866,550 A * | 2/1975 | Geschwender | A47B 3/12 | 108/157.14 |
| 3,892,189 A * | 7/1975 | Killam | A47B 47/021 | 108/109 |
| 4,111,482 A * | 9/1978 | Jones | A47B 3/14 | 108/36 |
| 5,947,037 A * | 9/1999 | Hornberger | A47B 13/083 | 108/115 |

(Continued)

FOREIGN PATENT DOCUMENTS

| | | |
|---|---|---|
| CN | 203246119 U | 10/2013 |
| DE | 1971212 U | 10/1967 |

(Continued)

*Primary Examiner* — Jose V Chen

(74) *Attorney, Agent, or Firm* — Slater Matsil, LLP

(57) ABSTRACT

The present disclosure relates to a table top, a leg and a worktable comprising a table top and legs. The table top has a honeycomb structure which extends along a main extension plane of the table top, with one or more areas being cut out from the honeycomb structure in accordance with a predetermined layout for receiving electrical and/or mechanical components. The leg has one or more decorative elements each having an areal main extension, the one or more decorative elements extending along their areal main dimensions over at least part of the surface of the leg and being fixed to the leg. Further, a worktable having such a table top and such a leg is described. A system comprising a worktable with a table top and legs of this type as well as a packaging for packing the worktable is also described.

6 Claims, 10 Drawing Sheets

(56) References Cited

U.S. PATENT DOCUMENTS

| | | | | |
|---|---|---|---|---|
| 6,042,203 | A * | 3/2000 | Bogucki | A47B 21/00 108/143 |
| 6,173,660 | B1 * | 1/2001 | Emmert | B25H 1/06 108/116 |
| 6,837,171 | B1 * | 1/2005 | Clark | A47B 13/086 108/131 |
| 8,176,858 | B2 * | 5/2012 | Leng | A47B 3/06 108/193 |
| 8,651,031 | B1 * | 2/2014 | Pazhoor | E04H 1/1255 108/115 |
| 10,321,755 | B1 * | 6/2019 | Sie | A47B 9/06 |
| 10,349,737 | B2 * | 7/2019 | Keller | |
| 2002/0043183 | A1 * | 4/2002 | Insalaco | A47B 21/06 108/50.02 |
| 2003/0089283 | A1 * | 5/2003 | Okamoto | A47B 17/02 108/50.02 |
| 2005/0081760 | A1 * | 4/2005 | Leng | A47B 13/08 108/27 |
| 2006/0086293 | A1 * | 4/2006 | Ryaboy | F16F 15/022 108/161 |
| 2007/0144409 | A1 * | 6/2007 | Zhu | G02B 7/00 108/28 |
| 2010/0000163 | A1 * | 1/2010 | Tsai | E04F 15/02405 52/126.6 |
| 2010/0186640 | A1 * | 7/2010 | Leng | A47B 3/02 108/119 |
| 2013/0001396 | A1 | 1/2013 | Ryaboy et al. | |
| 2013/0015300 | A1 | 1/2013 | Klinke | |

FOREIGN PATENT DOCUMENTS

| | | | |
|---|---|---|---|
| DE | 102007033220 | A1 | 4/2008 |
| DE | 202010018223 | U1 | 10/2014 |
| EP | 2140780 | A1 | 1/2010 |
| WO | 2018210651 | A1 | 11/2018 |

* cited by examiner

ELECTRICALLY HEIGHT-ADJUSTABLE TABLE

CROSS-REFERENCE TO RELATED APPLICATIONS

This application claims the priority of German patent application 102018110261.5, filed on Apr. 27, 2018, which application is hereby incorporated herein by reference.

TECHNICAL FIELD

The invention relates to a table top for a worktable, a leg for a worktable and a worktable comprising a table top and legs. The invention also relates to a system comprising a worktable comprising a table top and legs, and to a packaging.

BACKGROUND

Conventional worktables, such as desks used in the office or home office environment, follow relatively rigid concepts, wherein aspects of extensive functionality and aspects of flexible, adaptable and safe handling in various operating or application situations can only be combined with trade-offs and compromises.

SUMMARY

Embodiments provide a table top for a worktable, a leg for a worktable, the worktable itself and a system with such a worktable and a packaging of the kind mentioned above, which, following a systematic approach, harmonizes all aspects of an extensive functionality and a flexible, adaptable and safe handling in all operating and application situations.

According to embodiments the table top is arranged for a worktable and has a honeycomb structure that extends along a main extension plane of the table top. One or more areas are cut out from the honeycomb structure according to a predetermined layout to accommodate electrical and/or mechanical components.

A table top designed in this way for a worktable combines in a particularly advantageous way all aspects of a comprehensive functionality of the worktable with a flexible, adaptable and safe handling of the worktable. Electrical and/or mechanical components for a predetermined functionality of the worktable can thereby be accommodated in the one or more areas cut out from the honeycomb structure according to the predetermined layout. In this way, components for the electrical and/or mechanical functionality of the table top or a worktable using such a table top can be directly integrated into the table top. This has the advantage that electrical and/or mechanical components do not necessarily have to be mounted or accommodated on an upper or lower surface or a side surface of the table top (in a state when the table top is positioned on a worktable). By way of example, electrical components and their cabling can be integrated into the table top in such a way that they do not impede and even favor or simplify handling of the table top, for example, during assembly, during working on the table top, during transport or storage or even during other handling, for example, in the course of packaging or unpacking of the table top or else during such handling in relation to a worktable completed with this table top. Also for reasons of operational safety, electrical and/or mechanical components may in this way be enclosed within the honeycomb structure of the table top such that they do not present a danger to a user. In this respect, it is possible to prevent injury or other danger to a living being or damage to the electrical and/or mechanical components during handling the table top.

Also against the background of a flexible and adaptable design, the table top explained above offers advantages over conventional solutions. For example, the predetermined layout of the one or more areas cut out from the honeycomb structure of the table top allows a predetermined functional range of the table top to be taken into account, so that the table top can be flexibly equipped with electrical and/or mechanical components for certain desired functionalities, if necessary taking individual customer requirements into account. It is also possible to easily add a specific additional layout of cut-out areas to a specific (basic) layout of one or more cut-out areas of the honeycomb structure. For example, one or more additional areas of the honeycomb structure can easily be cut out to add certain functionalities (of electrical and/or mechanical nature) to the table top. Cutting out one or more layouts with the corresponding areas can be done, for example, during the production of the table top.

A manufacturing process for a table top of the type explained may include the step of cutting out one or more areas from the honeycomb structure according to one or more predetermined layouts. In this way, the table top can be very flexibly adapted to specific customer requirements.

Electrical components of the type explained can be, for example, components for the height adjustment of a worktable with which the described table top is used. Other electrical components may include, for instance, an electrical energy supply for electrical or electronic devices such as power supplies, inductive charging devices (so-called wireless charging mats), and so on. Electronic devices such as indicating elements, displays, electronic authentication devices, card readers, RFID readers, NFC readers, biometric identification devices or electronic security devices can also be provided as electrical components.

Mechanical components of the type explained may include, for example, functional accessories such as drawers, shelves, covers, brackets, line routing channels, cables, and so on.

Due to the construction of the table top comprising the honeycomb structure extending along a main extension plane of the table top, the latter is stable in its structure despite one or more cut-out areas and can be designed so as to have sufficient firmness against all loads, bending moments, and so on. In addition to stability, another advantage of the honeycomb structure is that the table top can still be realized with a relatively low weight compared to conventional solutions. The honeycomb structure, for example, is designed as a honeycomb core with hexagonal honeycombs. Of course, other honeycomb shapes are also possible. For example, the honeycombs are made of 100% recycled paper or cardboard. In this respect, the materials of the honeycomb structure are environmentally friendly, degradable or recyclable.

The term "main extension plane" of the table top describes a main extension or main dimension of the table top with a given length and width of the table top, wherein the main extension plane of the table top is considerably larger compared to extensions of the table top in other spatial directions (depth or thickness of the table top). In this respect, the main extension plane of the table top comprises the working surface of the table top.

In various embodiments, the table top has two panel elements which are arranged spaced apart from each other in a thickness direction (depth direction) perpendicular to the main extension plane (spanned by length and width) of the table top. The honeycomb structure is arranged between the two panel elements of the table top. The two panel elements can, for example, each be designed as chipboard. One or both of the panel elements can also be coated with a decorative coating.

By way of example, a manufacturing method of the type explained above for manufacturing the table top comprises the steps of gluing the honeycomb structure (after cutting out the one or more areas from the honeycomb structure) to the respective panel elements and, optionally, bordering this arrangement with an edge strip, side strip or corresponding veneer, for example, by gluing. All gluing processes can be carried out, for example, using a formaldehyde-free polyurethane adhesive system.

Due to the construction of the table top with two panel elements enclosing the honeycomb structure, any electrical and/or mechanical components of the type explained above, which are accommodated in the one or more areas cut out from the honeycomb structure, can be accommodated in the table top so as to be completely protected from access by a user. In this way, the electrical and/or mechanical components are virtually "potted" in the table top. Such a construction of the table top further improves the operational safety.

In certain embodiments of the table top, for example, only one power cable leads out of the table top at a predetermined point, for example, to connect electrical components inside the table top to the mains. Otherwise, all other components within the table top may be enclosed within the table top, preferably completely enclosed therein. In these embodiments, one or more covers may be provided to allow access to the components or areas integrated into the table top. This can be advantageous for maintenance purposes or for component replacement or for extending the table top with certain electrical/mechanical functionalities of the type explained above.

In various configurations of the table top, however, openings may be provided in the table top and the electrical and/or mechanical components may enter these openings or extend out from these. For example, the table top may have openings for legs to build a complete worktable. The legs can then be inserted and mounted in these openings (mounting openings).

The table top of the type explained above is advantageously used in a worktable that has legs in addition to the table top. The table top is then designed as described above. A worktable of this type also combines all aspects of extensive functionality in an advantageous way with a flexible, adaptable and safe handling in all operating and application situations.

In various embodiments, a worktable constructed in this way is electrically height-adjustable. One or more control components for controlling the electrical height adjustment are integrated in the one or more areas cut out from the honeycomb structure. Due to the construction of the table top in accordance with the above explanations, a full integration of all control components and an associated cable management of the electrical wiring of the control components (and any drives) for the electrical height adjustment is made possible. Compared to conventional solutions, such a worktable has the advantage that the corresponding control components and their cabling are not openly mounted on the table or table top so that they are accessible to a user and are subject to possible damage, danger to the user or misuse. Rather, such components are embedded in the table top with the worktable of the type explained here and covered so as to be inaccessible to the user during normal handling. Such a worktable thus combines in a particularly advantageous way an extended functional range of height adjustment with a flexible and yet safe handling of the worktable. The worktable thus offers advantages over conventional solutions, particularly in applications of the worktable in an office environment or home office environment. Against the background of operational safety, the worktable thus protects people and living creatures that come into contact with it (e.g., employees/personnel in the office environment or people, especially children, pets and so on in the home office environment).

In various embodiments of the worktable having an integrated electrical height adjustment of the type explained, the one or more control components include an electrical safety device for enabling or disabling the electrical height adjustment. The electrical safety device has a contact element to interact with a mating contact element to enable or disable the electrical height adjustment. For example, a corresponding safety device is realized by a user card (smartcard) having a contact element and, when the user card is inserted into a corresponding device on the worktable, the contact element cooperates with a mating contact element to enable or disable the electrical height adjustment. The interaction between the contact elements may occur, for instance, by electrical and/or magnetic and/or mechanical ways and means.

In various embodiments of the worktable of the type explained above, the legs or parts of the legs (e.g., leg or column elements) can be variably positioned in their orientation relative to the main extension plane of the table top. The legs or parts of the legs can be positioned to be parallel or almost parallel to the main extension plane of the table top in a first assembly state, while they can be positioned perpendicular to the main extension plane of the table top in a second assembly state. In the latter position, the legs or parts of the legs may be fixed relative to the table top. It is advantageous to have the ability to switch between the first and the second mounting position. The variable positioning of the legs or parts of the legs in their orientation relative to the main extension plane of the table top has the advantage that the worktable can be transported and stored in a very compact way when not in use. For this purpose, the legs or parts of legs are brought into the first described assembly state in their orientation in relation to the table top. In this form, the worktable can be packed, transported and stored in a space-saving and compact way. For example, the worktable can be packaged in a compact, small-volume package.

The integration of the electrical and/or mechanical functions into the table top, as explained above, facilitates the possibility of changing the orientation of the legs or parts of the legs relative to the table top, as explained above. As the electrical and/or mechanical components can be integrated inside the table top, the interaction between the table top and the legs (apart from the necessary wiring for electrical components inside the legs, for example, for an electrical height adjustment of the above type or similar) can be kept free from components required for a functional range of the worktable. These are completely enclosed in the table top or in the legs. This means that the worktable can be made available to an end customer as a compact package in a quasi "folded" position of the legs or parts of the legs relative to the table top. The customer only has to move the legs or parts of the legs in their orientation relative to the table top from the first assembly state to the position according to the second assembly state and fix the legs or parts of the legs in this position relative to the table top. In this way, the worktable can be installed in a very easy manner at the end customer without the need for laying complicated wiring or installing electrical/mechanical components.

An orientation of the legs or parts of the legs relative to the table top in the first assembly state parallel or almost parallel to the main extension plane of the table top means here that the legs or parts of the legs, in their main extension (which ultimately determines the height of the mounted worktable), are positioned parallel or almost parallel to the main extension plane of the table top. The term "parallel or almost parallel" means that the legs or parts of the legs are oriented at an angle of almost 0° or at a very small angle (considerably smaller than 90°) in their main extension with respect to the main extension plane of the table top. In the second assembly state, however, the legs or parts of the legs are oriented vertically with respect to the table top, i.e., at an angle of 90° or almost 90° relative to the table top.

In various embodiments of the worktable having an electric height adjustment of the type explained above in combination with a variable orientation of the legs or parts of the legs relative to the table top, as also explained above, electric drives for electric height adjustment are integrated in the legs or parts of the legs. The electric drives are connected via one or more cables to one or more control components (integrated in the table top). A retraction mechanism can be integrated into the table top or into the legs or parts of the legs to retract the one or more cables of the electric drives when the legs or parts of the legs are brought from the first assembly state to the second assembly state. Such a design supports cable management of the type explained above in that, during the assembly of the worktable, a user need only move the legs or parts of the legs from the first assembly state to the second assembly state, wherein the cables extending between the legs or parts of the legs and the table top are automatically pulled into the table top or legs or parts of the legs via the retraction mechanism. The one or more cables are advantageously laid in such a way that they run inside the legs or parts of the legs and, when the legs or parts of the legs are installed, are completely enclosed in the second state by the legs or parts of the legs or the table top without being accessible from outside. An appropriate retraction mechanism may be, for example, a pre-stressed (spring-loaded) bearing of a pulling or winding mechanism which is released when a leg or part of a leg is raised from the first assembly state. This causes the cable to be pulled in or guided accordingly, while the leg or part of the leg is positioned in the second mounting position, so that the cable is automatically retracted and jamming of a cable loop between the leg or part of the leg and the table top is prevented.

The leg is arranged for a worktable and has one or more decorative elements, each with an areal main dimension. The one or more decorative elements extend along their areal main dimensions over at least part of the surface of the leg and are fixed to the leg. One or more decorative elements can be fixed to the leg, for instance, by means of one or more magnetic elements, a magnetic foil, adhesive foil, Velcro or similar. It can be advantageous to fix the one or more decorative elements to the leg in such a way that the one or more decorative elements are detachably fixed to the leg. This is advantageously arranged in such a way that detaching can be carried out without damaging or destroying the leg or a corresponding decorative element.

A leg of this type also combines extensive functionality or adaptability of a worktable with simplified handling against the background of a systematic approach. The leg designed in this way makes it easy to adapt or replace decorative elements on the leg without having to replace, damage or destroy the entire leg or any other parts of the leg. For the purpose of replacing a decorative element with another decorative element, it is only required to remove the first decorative element from the leg, and a new decorative element can be attached to the leg. In this way, the leg can be adapted to various decorative elements, for example, to match the surface decor of a table top of a worktable in which the leg is employed.

The advantage of a leg designed in this way is that it can be used in a worktable which has one or more such legs. In various embodiments, such a worktable is designed according to the way explained above in connection with the first aspect.

The system includes a worktable with a table top and legs as well as a packaging. The table top has mounting openings or mounting brackets to accommodate the legs or parts of the legs in a mounted position perpendicular to a main extension plane of the table top. In the system, the legs or parts of the legs (in their main extension) are stored parallel or almost parallel to the main extension plane of the table top in a disassembled position. The legs or parts of the legs are held in the disassembled position by means of one or more first packaging elements of the packaging which at least partially surround or enclose the legs or parts of the legs. The mounting openings or mounting brackets in the table top are concealed by one or more second packaging elements of the packaging. In the system, the table top, the legs or parts of the legs as well as the first and second packaging elements are at least partially surrounded by one or more overpack elements of the packaging.

Such a system advantageously reconciles the advantages of a worktable with legs or parts of legs that are variable in position relative to the table top with a specially dedicated and designed (smart) packaging that holds the worktable in a compact storage configuration with the correspondingly dismantled legs or parts of legs and securely accommodates them in the packaging. At the same time, the mounting openings or mounting brackets in the table top are protected against dirt and damage.

The packaging described thus enables safe transport and safe storage of the compact worktable in the explained position of the legs or parts of the legs relative to the table top. A further advantage of the packaging described here is that it is technically designed in such a way that building up the worktable or the assembly of the legs or parts of the legs and the disassembly of the worktable or the dismantling of the legs or parts of the legs are supported by the packaging itself and by the first and second packaging elements comprised by the packaging.

The first and second packaging elements are designed and integrated into the packaging in such a way that, in addition to protecting the parts of the worktable, their arrangement and positioning within the packaging also support the individual steps for unpacking and assembling the worktable (and corresponding steps for packing and disassembling the worktable). In this way, the packaging itself simplifies the assembly of the worktable from the explained system and the disassembly of the worktable and packaging of the worktable to the described system. The position of the individual packaging elements dictates the sequence of the steps to be performed for assembling or disassembling the legs or parts of the legs relative to the table top.

Such a system also supports and facilitates the handling of the worktable in an operating situation involving the assembly of the worktable or the disassembly of the worktable.

The functionality of the worktable is brought in line with the position and function of the first and second packaging elements of the packaging in a synergistic way.

In various embodiments of the explained system, the worktable is designed according to the embodiments or further developments as explained above with regard to the first and second aspects.

All aspects of the disclosure of a table top, a leg as well as of a worktable and a system comprising such a worktable and an illustrated packaging presented here work together in a synergistic manner such that, following a systematic approach, a worktable comprised of its components table top and leg is created which is improved with respect to its handling and flexible adaptation to a desired functional range. Such a systematic approach extends not only to the proper handling of the worktable but also to the assembly or disassembly and the associated packaging of the worktable.

BRIEF DESCRIPTION OF THE DRAWINGS

The disclosure is explained in more detail below with the aid of several drawings.

In the Figures.

DETAILED DESCRIPTION OF ILLUSTRATIVE EMBODIMENTS

Figure 1:
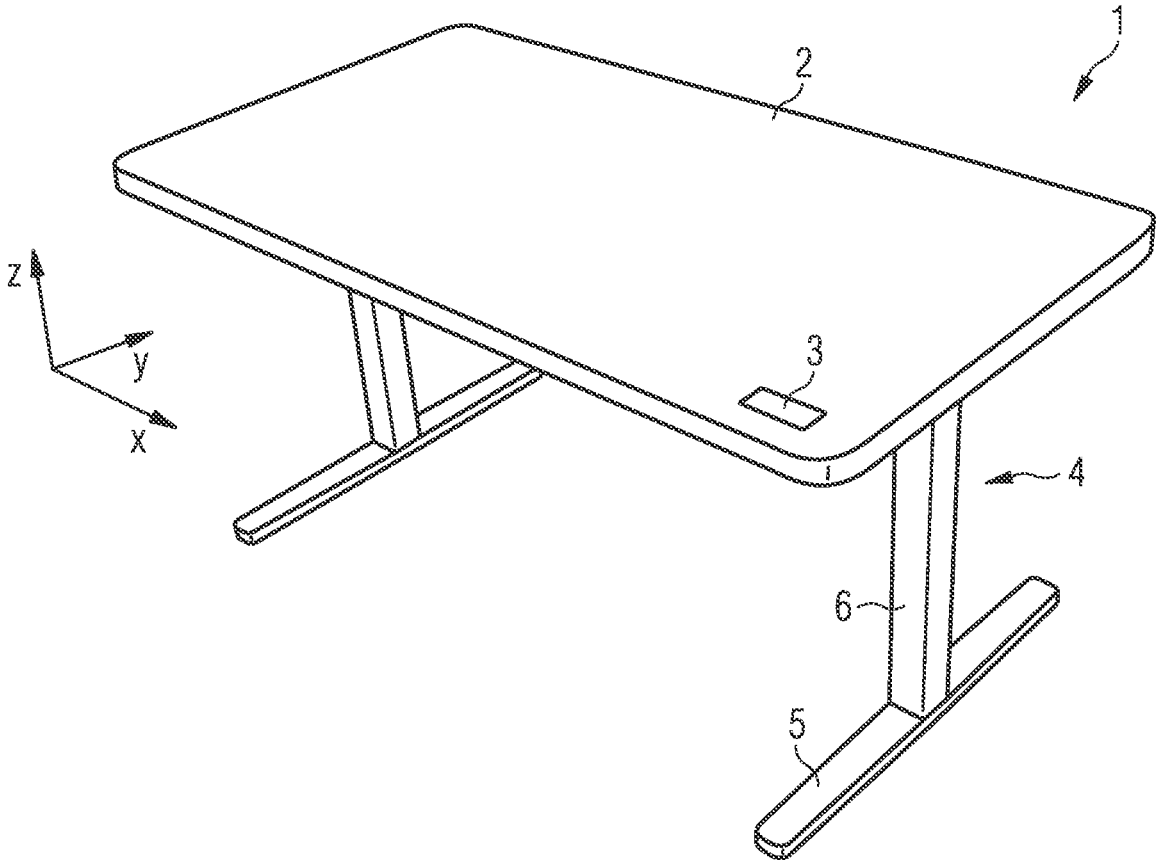
FIG. 1 is a perspective view of an embodiment of a worktable according to the present disclosure.

FIG. 1 shows an embodiment of a worktable 1 according to the present disclosure. The worktable 1 comprises a table top 2 and two legs 4. The worktable 1 is adjustable in height according to the embodiment in FIG. 1. For this purpose, electric drives (not shown) are installed in the legs 4. Each leg 4 comprises a base 5 for placing on a support surface and a column 6. For height adjustment, the electric drives are integrated, e.g., within the columns 6 of the legs 4. This allows the legs 4 to be changed in a Z-direction with respect to an extension length of the columns 6, making the worktable 1 height-adjustable in direction Z. For example, the columns 6 of the legs 4 can be constructed in such a way that two or more elements engage each other and can be changed in their length relative to each other or moved electrically via the electric drives.

In addition, the worktable 1 on its table top 2 includes an electrical operating panel 3 for controlling the height adjustment. For example, the operating panel 3 can have two pushbuttons and optionally a display or other electronic components. For example, the pushbuttons on the operating panel 3 can be used to control the electric drives for height adjustment of the legs. For example, a pushbutton can adjust the height in the Z-direction (upwards) and a pushbutton can adjust the height contrary to the Z-direction (downwards).

In accordance with the embodiment in FIG. 1, all electrical and/or mechanical components of the worktable 1, apart from the table top 2 and legs 4 themselves, are integrated within the table top 2 or the legs 4. This means that in the installed state of the worktable 1 as shown in FIG. 1, no electrical and/or mechanical components are arranged on the legs 4 or on the table top 2 so as to be accessible to a user (apart from the operating panel 3). Even any wirings or other components are integrated within the worktable 1. In this way, the worktable 1 ensures a very high level of operational safety.

With regard to the dimensions of worktable 1, it should be noted that table top 2 extends along a main extension plane, which is spanned in the X and Y directions according to FIG. 1. The work surface of the table top 2 therefore corresponds to the main extension plane of the table top 2. The main extension plane of the table top 2 therefore describes the main dimensions of the table top 2 in the directions X and Y. For example, the table top 2 according to the embodiment of FIG. 1 may have a length along the X-direction of 140 cm, a width along the Y-direction of 75 cm and a depth (thickness) in the Z-direction of 3.8 cm. The table top 2 is therefore much longer and wider in its main extension plane as compared to its thickness in a vertical direction (Z-direction).

The worktable 1 of the embodiment shown in FIG. 1 may be adjusted, for example, from a height (along Z-direction) of at least 68 cm up to a maximum of 118 cm. The dimensions and height dimensions explained are of course only exemplary and may deviate from the cited values in other embodiments.

Figure 2A:
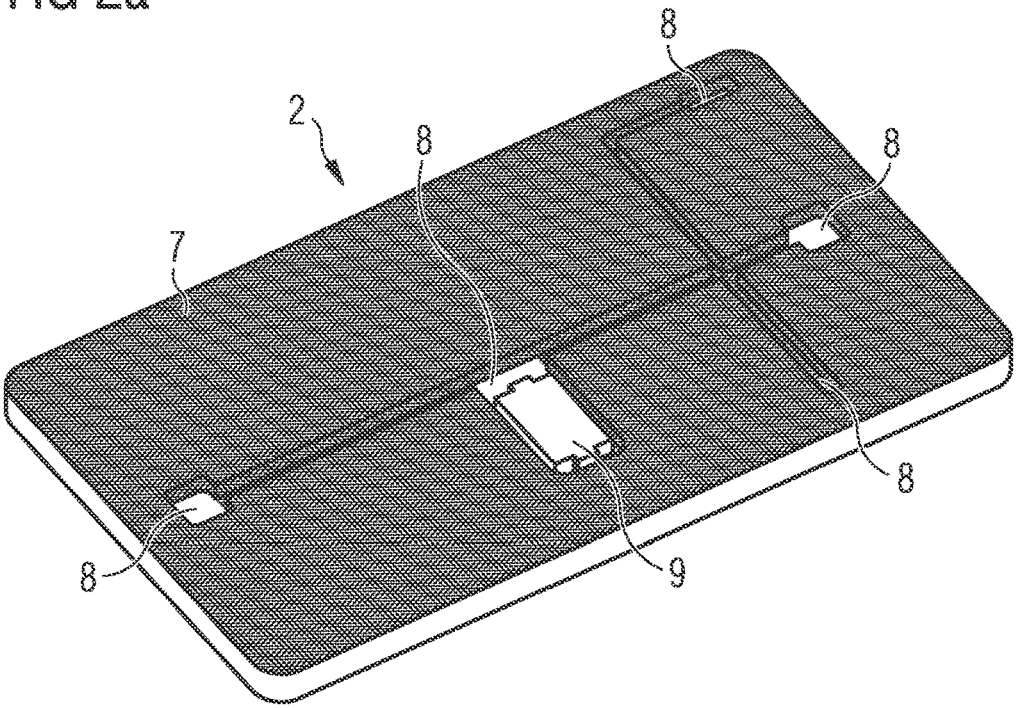
FIGS. 2*a* and 2*b* are views of components according to an embodiment of a table top according to the present disclosure.
Figure 2B:
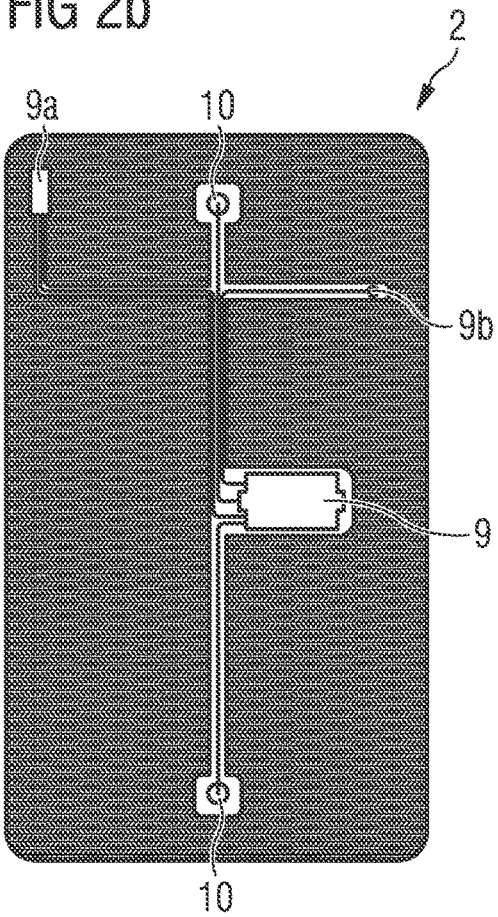

FIGS. 2*a* and 2*b* show views of components of an embodiment of a table top 2 according to the present disclosure. Such a table top 2 can be used, for example, in the embodiment of a worktable 1 according to FIG. 1.

In the views according to FIGS. 2*a* and 2*b*, only part of the table top 2 is shown, with an upper panel element of the table top 2 being removed so that the view at internal components integrated within the table top 2 is unobstructed.

First, reference is made to FIG. 2*a* showing a perspective representation. The table top 2 has a honeycomb structure 7 that extends along a main extension plane (see, for example, above explanations to FIG. 1) of the table top 2. The honeycomb structure 7 is designed as a honeycomb core with a large number of built-up honeycombs. The honeycombs may be realized, for example, as hexagonal honeycombs. It goes without saying that other shapes are conceivable as well. The honeycombs of the honeycomb structure 7 are constructed as wall structures whose walls are oriented perpendicular to the main extension plane of the table top 2, i.e., in a thickness direction (Z direction according to FIG. 1). The honeycomb structure 7 in the form according to FIG. 2*a* can be made of 100% recycled paper or recycled cardboard, for example. This enables an environmentally friendly design of the table top 2 and nevertheless gives the table top 2 sufficient stability with regard to all operational loads.

As shown in FIG. 2*a*, several areas 8 are cut out from the honeycomb structure 7 according to a predetermined layout and are arranged to accommodate electrical and/or mechanical components. According to the embodiment in FIG. 2*a*, a component 9 is accommodated in a centrally located area 8, for instance. The component 9, for example, may be a control component for controlling the electrical height adjustment (see FIG. 1 for details).

The cut-outs in the honeycomb structure 7 can be cut or milled into the honeycomb structure 7 according to the layout shown, for example, during a manufacturing process of the table top 2, or can be formed in any other way. In doing so, the honeycombs of the honeycomb structure 7 are cut at their walls in such a way that the layout shown in FIG. 2*a* is created with the cavities or areas 8 and the channels connecting the areas 8.

FIG. 2*b* shows the components according to FIG. 2*a* in a plan view. Here, it can be seen that the cavities and channels (cut-outs), which are cut out from the honeycomb structure 7, provide the corresponding areas 8 for receiving the electrical and/or mechanical components. For example, electrical and/or mechanical components 9, 9*a*, 9*b*, 10, etc. may be provided in the respective areas 8 according to the configuration in FIG. 2*b* for height adjustment of the worktable in which the table top 2 is employed according to FIGS. 2*a* and 2*b*. The components 9, 9*a*, 9*b*, 10 may also have other components 9*a* and 9*b* for operating or controlling the height adjustment in addition to the control component 9 already explained with FIG. 2*a*. For example, an operating element 3 according to FIG. 1 can be integrated into the table top as component 9*a* according to FIG. 2*b*. The control component 9 according to FIG. 2*b* may be, for example, a motor control unit for controlling one or more electrical drives for height adjustment (see explanations according to FIG. 1). As an alternative or in addition, the components 9, 9*a* may also have other functionalities. The component 9*b* may be arranged, for example, as a cable guide or length compensation for a cable guide between the other components 9, 9*a* and 10. For example, component 9*b* may have a retraction mechanism for retracting or releasing an electrical wiring toward the components 10 of table top 2. Such functionality is explained in more detail below.

The components 10, according to FIG. 2*b*, represent recesses or mounting openings in the table top 2 to accommodate legs for the assembly of an entire worktable, as it is illustrated by way of example in FIG. 1. The mounting openings 10 can be milled into one or more panel elements of table top 2, for instance.

All cablings and any other electrical and/or mechanical connections between the components 9, 9*a*, 9*b* and 10 are routed in the embodiment according to FIG. 2*b* within the cavities or channels (cut-outs) cut out from the honeycomb structure 7 (see also FIG. 2*a*). In addition to the components 9, 9*a*, 9*b* and 10 shown in FIGS. 2*a* and 2*b*, other or additional components may also be accommodated as an alternative or in addition. For example, further electrical components may be housed in corresponding areas 8 of the honeycomb structure 7 to provide additional electrical functions of the table top 2 in addition to an electrical height adjustment. These may be, for example, an inductive charging function for mobile electronic terminal equipment. Further mechanical components can be, for example, holders or receptacles for additional components such as drawers, covers, etc., which are integrated into the table top 2.

Due to the design of the table top 2 shown in FIGS. 2*a* and 2*b* using a honeycomb structure 7 with corresponding areas or cavities and channels 8, electrical and/or mechanical components of all kinds can be integrated directly into the table top 2. As a result, the table top 2 can be constructed in such a way that no components need to be attached to outer surfaces of the table top 2. Wirings or mechanical connections between components can also be integrated into the table top 2 in a protected manner and "potted" therein to a certain extent. The table top 2 may be arranged such that, for example, only one power cable (not shown) leads out of the table top 2 at a predetermined point, for example, to connect electrical components 9, 9*a* inside the table top 2 to the mains supply. For example, this power cable may come from component 9. With the exception of this power cable, all other wirings can be accommodated within the honeycomb structure 7 of the table top 2.

Figure 3:
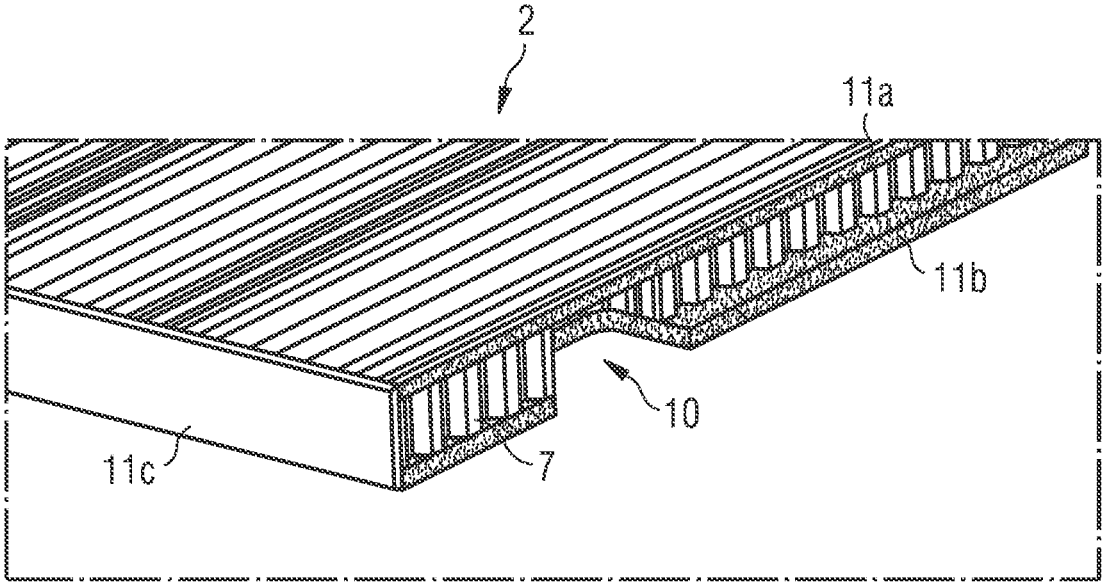
FIG. 3 is a perspective illustration of a part of an embodiment of the table top according to the present disclosure.

FIG. 3 shows a part of an embodiment of a table top 2 as it can be used, for example, as table top 2 according to FIGS. 1 to 2*b*. In accordance with the embodiment shown in FIG. 3, the table top 2 comprises two panel elements 11*a* and 11*b*, which are arranged spaced from each other in the thickness direction (Z direction according to FIG. 1) perpendicular to a main extension plane (along the X and Y directions according to FIG. 1) of the table top 2. A honeycomb structure 7 (see, for example, explanations to FIGS. 2*a* and 2*b*) is arranged between the two panel elements 11*a* and 11*b*. The layering of the panel elements 11*a* and 11*b* and the honeycomb structure 7 accommodated between them is enclosed by a further lateral panel element 11*c* which is arranged in its main dimension perpendicular to the panel elements 11*a* and 11*b*. FIG. 3 illustrates the arrangement of the walls of the honeycomb structure 7 perpendicular to the respective main extensions of the two panel elements 11*a* and 11*b*. The honeycomb structure 7 according to FIG. 3 may be similar to the honeycomb structure 7 according to FIGS. 2*a* and 2*b*. As an alternative, the honeycomb structure 7 according to FIG. 3 may differ from the honeycomb structure 7 according to FIGS. 2*a* and 2*b*.

The two panel elements 11*a* and 11*b* and/or the panel element 11*c* may be designed as a chipboard having a decorative coating, for example. The respective decorative coating forms an aesthetic appearance provided on the outer surfaces (outer sides) of the table top 2. The two panel elements 11*a* and 11*b*, and if applicable the panel element 11*c*, are glued to the honeycomb structure 7, for example. Such bonding is carried out, for example, by a high-quality formaldehyde-free polyurethane adhesive system.

The honeycomb structure 7 according to FIG. 3 may have corresponding areas or cavities and channels 8 as explained in connection with FIGS. 2*a* and 2*b* above. Corresponding areas, cavities and channels 8 are cut out from the honeycomb structure 7. In addition, the embodiment according to FIG. 3 shows a recess or mounting opening 10 cut from the lower panel element 11*b*. Mechanical and/or electrical components can be accommodated within the recess or mounting opening 10. These components may include, for example, the legs 4 of a worktable 1 according to FIG. 1 and/or the components 9, 9*a*, 9*b*, 10 according to FIGS. 2*a* and 2*b*.

Figure 4A:
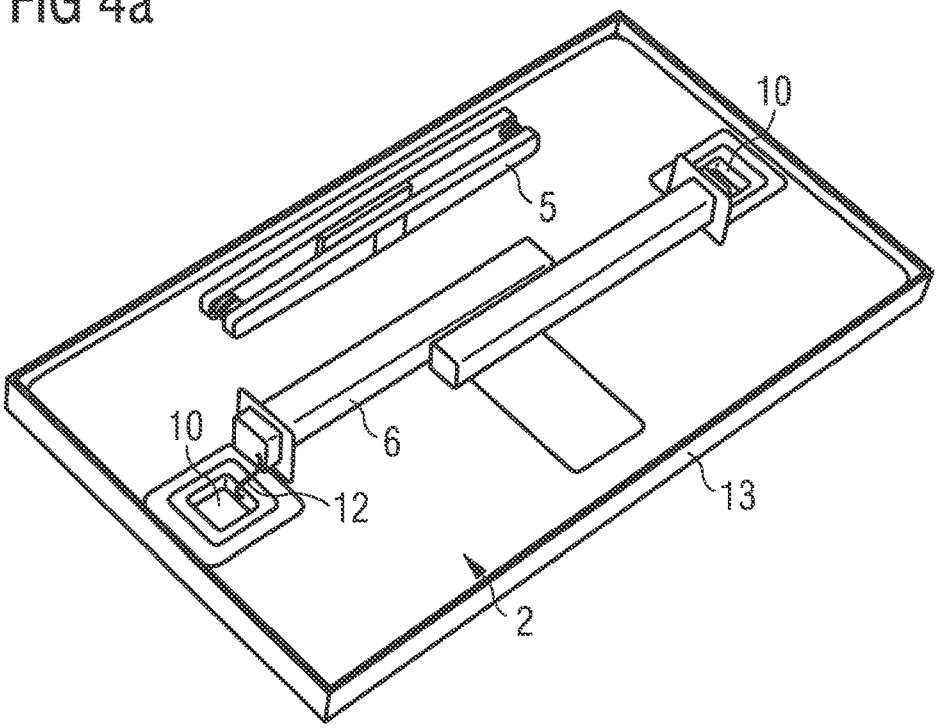
FIGS. 4*a* and 4*b* are views of the worktable according to FIG. 1 in various dismantled states.
Figure 4B:
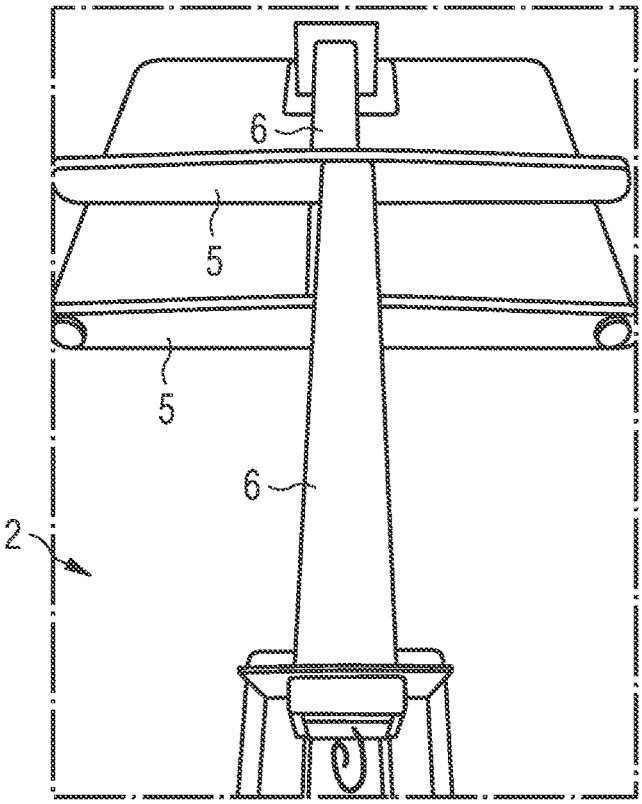

FIGS. 4*a* and 4*b* show a worktable 1 as it is constructed, for example, according to the embodiment of FIG. 1, in alternative dismantled states. FIG. 4*a* shows a first embodiment, whereas FIG. 4*b* shows an alternative, second embodiment.

FIG. 4*a* shows a table top 2 of the worktable 1 which is received in a frame-shaped overpack element 13 of a packaging. The overpack element 13 may be part of a packaging as described below.

The columns 6 of two legs 4 (see, e.g., FIG. 1) are arranged according to the arrangement in FIG. 4*a* in their respective main extensions parallel or almost parallel to a main extension of the table top 2. The respective bases 5, which together with the corresponding columns 6 form a leg 4 according to FIG. 1, are also arranged in their main extensions so as to be parallel or almost parallel to the main extension of the table top 2 offset next to the columns 6. FIG. 4*a* also illustrates two mounting openings 10 in which the respective columns 6 can be inserted and fixed for mounting the legs 4 according to FIG. 1. In accordance with the embodiment in FIG. 4*a*, the columns 6 can be screwed to an edge area of the mounting openings 10 using screw connections. For this purpose, the two columns 6, which are arranged laterally offset from a straight line between the two mounting openings 10 for space-saving storage according to FIG. 4*a*, can each be swiveled upwards and moved toward the respective mounting opening 10 so that they are swiveled by 90° from the position shown in FIG. 4*a* and inserted into the associated mounting opening 10. The columns 6 can then be screwed to the edge areas of the mounting openings 10 using screws.

The cables 12, which establish an electrical connection between electrical components integrated in the columns 6 (for example, drive components for height adjustment) and further electrical components within the table top 2, can be automatically pulled into the table top 2 via a retraction mechanism as described above as component 9*b* in conjunction with FIG. 2*b*, as soon as the two columns 6 are swiveled upward starting from the position illustrated in FIG. 4*a*. This prevents the cables 12 from impeding this process or from being damaged, kinked or pinched during the assembly of the columns 6. Finally, the two bases 5 can each be connected to the upper ends of the columns 6 fixed in the mounting openings 10 by means of screw connections, so that the legs 4 are constructed according to FIG. 1.

As an alternative to the embodiment shown in FIG. 4*a*, other locking mechanisms may also be provided. For example, hinged swivel mechanisms may be provided to swivel the columns 6 from an orientation parallel to the table top 2 to an orientation perpendicular to the table top 2, so that the columns 6 are swiveled in their main dimensions by 90° with respect to the table top 2 and point vertically upwards away from the table top 2. The columns 6 can be locked in place in the final mounting position at or in the mounting openings 10 by means of appropriate locking means on the swivel mechanisms. Such locking means can be designed in such a way that the columns 6 automatically lock in place in the mounting openings 10 in the final mounting position.

The arrangement of the components according to FIG. 4*a* allows space-saving storage of all components for storage or transport of a complete worktable 1 according to FIG. 1. The arrangement according to FIG. 4*a* can be used, for example, in the context of a suitably selected smart packaging of all components, wherein the components can be stored or transported safely, easily and yet in a space-saving manner.

FIG. 4*b* shows an alternative embodiment to FIG. 4*a*, wherein in contrast to FIG. 4*a* the legs are equipped with columns 6 and the bases 5 already mounted on them. The bases 5 are screwed or otherwise connected perpendicular to the columns 6. In this way, two essentially T-shaped legs are formed (see also FIG. 1). The two T-shaped legs are arranged almost parallel to a main extension plane of table top 2 according to FIG. 4*b* and thus form a dismantled state in analogy to the state according to FIG. 4*a*. Analogous to a procedure according to FIG. 4*a*, the legs according to FIG. 4*b* on the columns 6 can be swiveled by 90° or almost 90° upwards so that the columns 6 are arranged perpendicular to the table top 2 in corresponding mounting openings 10 (see FIG. 4*a*). The columns 6 can then be fixed in or at the mounting openings 10 in analogy with the explanations according to FIG. 4*a*. For further details, reference is made to the explanations in FIG. 4*a*.

FIGS. 5*a* to 5*d* show an embodiment of a concept for securing the electrical operability of a worktable 1 which may be designed according to FIG. 1, for example. The electrical operability may be, for example, an electrical height adjustment of the type explained above. However, the electrical operability may alternatively or additionally also be any other electrical functionality for operating or using the worktable 1.

Figure 5B:
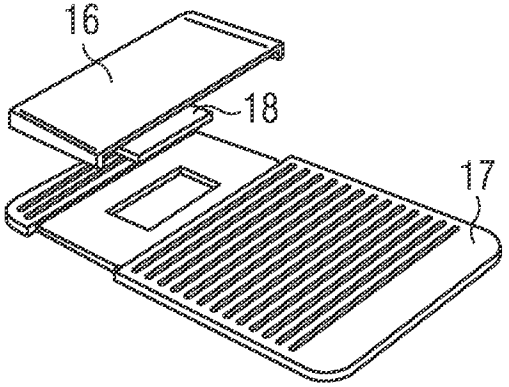
FIGS. 5*a* and 5*b* are perspective views of an embodiment of a card for controlling a safety device of a worktable according to the present disclosure.
Figure 5D:
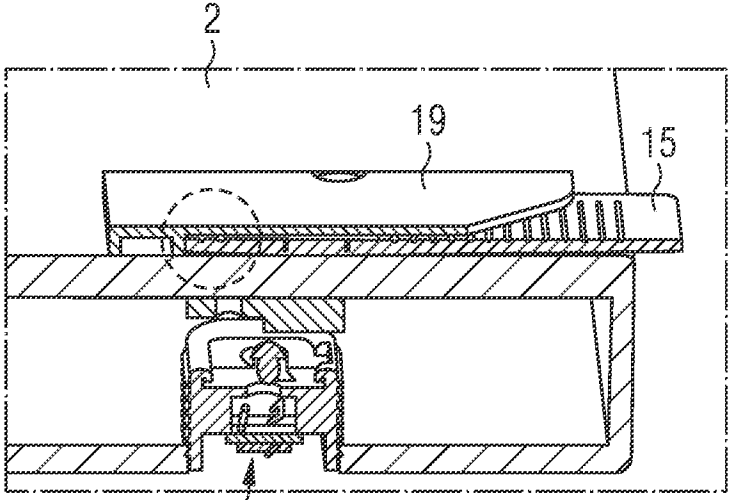
FIGS. 5*c* and 5*d* are views of a part of an embodiment of a worktable according to the present disclosure with a card inserted therein as shown in FIGS. 5*a* and 5*b*, FIGS. 6*a* and 6*b* are perspective views of components of an embodiment of a leg according to the present disclosure for a worktable.
Figure 5A:
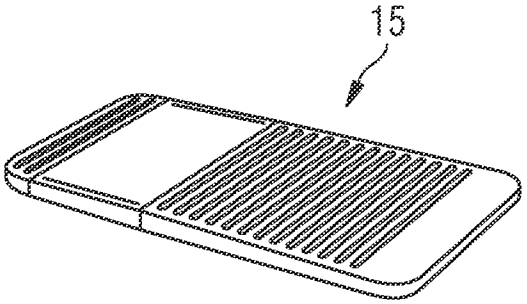

First, FIGS. 5*a* and 5*b* show an operating element in the form of a card 15 which a user of the worktable carries with him. The housing of the card 15, for example, can be made of plastic. In accordance with the embodiment in FIG. 5*b*, the card 15 of FIG. 5*a* comprises a base body 17 and a cover 16, which has a mating contact element 18 for interaction with a contact element of a safety device integrated within the table top 2 of the worktable. This is explained in more detail below. The mating contact element 18 comprises a magnet in the embodiment according to FIG. 5*b*.

Figure 5C:
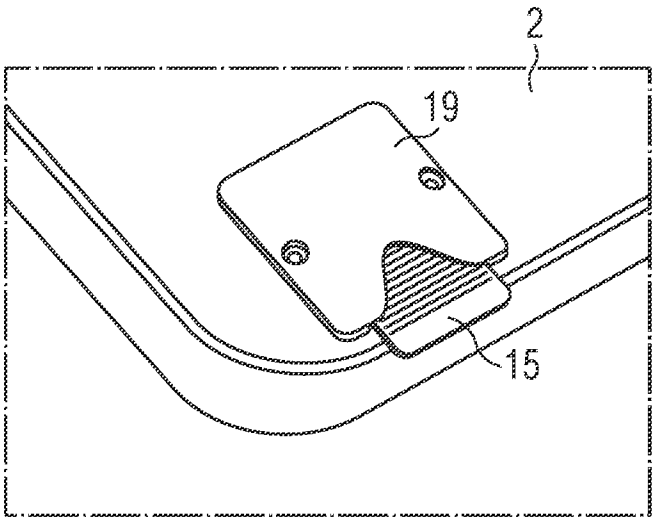

According to FIG. 5*c*, the card 15 can be inserted by a user into a holder 19 attached to an outer surface of the table top 2. In the embodiment according to FIG. 5*c*, the table top 2 can be designed and arranged similar to the table top 2 of the type explained above. As illustrated in FIG. 5*d*, the card 15 is inserted into the holder 19 on the table top 2. The magnet 18 (see FIG. 5*b*) thus interacts with a contact element of a safety device 14 integrated inside the table top 2. The safety device 14 may be located, for example, inside a recess or within an area, cavity or channel 8 cut out from the honeycomb structure 7 of a table top 2 of the type explained above.

For example, a contact element of the safety device 14 for interaction with the magnet 18 of card 15 may be a Reed contact. By magnetic interaction with the magnet 18, two Reed contact elements can be closed when the card 15 according to FIG. 5*d* has its magnet 18 positioned in the vicinity. By closing the Reed contact elements, an electrical circuit within the safety device 14 can be closed so that a corresponding electrical functionality or electrical operability of electrical or electronic components within the table top 2 and/or within the legs 4 of worktable 1 (see FIG. 1) is operative.

If, on the other hand, the card 15 is removed from the arrangement according to FIG. 5*d*, the magnet 18 no longer interacts with the corresponding Reed contact elements of the safety device 14 within the table top 2, wherein the Reed contact elements are opened or kept open. This also results in an electrical circuit inside the table top 2 being kept open, which suppresses the respective electrical functionality or electrical operability.

The contact elements and mating contact elements of safety device 14 and card 15 can alternatively also be realized in other ways such as in electrical, electronic, electromechanical or electromagnetic fashion, etc.

In addition to the arrangement shown in FIG. 5*d*, it should also be noted that the card 15 is held firmly mechanically in the holder 19. For this purpose, a projection may be provided on the inside of the holder 19 which engages in a groove on the card 15 and holds the card 15 in the holder 19. This is highlighted by a circular mark in FIG. 5*d*. This prevents the card 15 from slipping out of the holder 19 and surprisingly or abruptly opening or interrupting an electrical circuit.

The mechanisms, components and measures explained in FIGS. 5*a* to 5*d* may be arranged, for example, as a child safety device for a table top 2 or for a worktable 1 of the type explained above. This is particularly advantageous in the home office environment. Alternatively or in addition, a personalized operability of a table top 2 or a worktable 1 of the type explained above can also be realized in this way. This can be used, for example, in an office environment to ensure that only an authorized user who is in possession of a corresponding card 15 can carry out a corresponding operability of the type explained. Furthermore, certain parameters such as a personalized height setting (memory function) can also be implemented, which are adjusted or set when card 15 and safety device 14 interact. As an alternative to card 15, key fobs (so-called badges) can also be implemented. As a further alternative, corresponding functionalities of the type explained above may also be integrated in portable mobile terminal devices such as smartphones, smartwatches or similar.

Figure 6A:
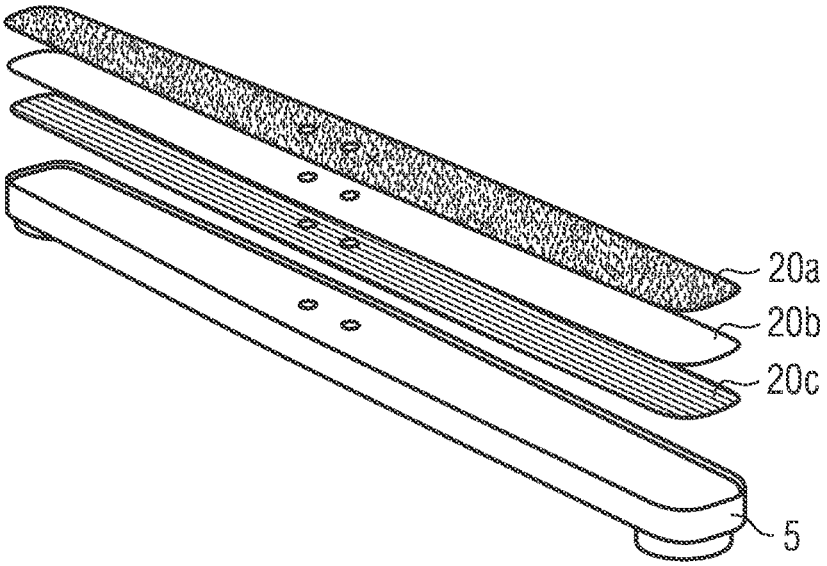
Figure 6B:
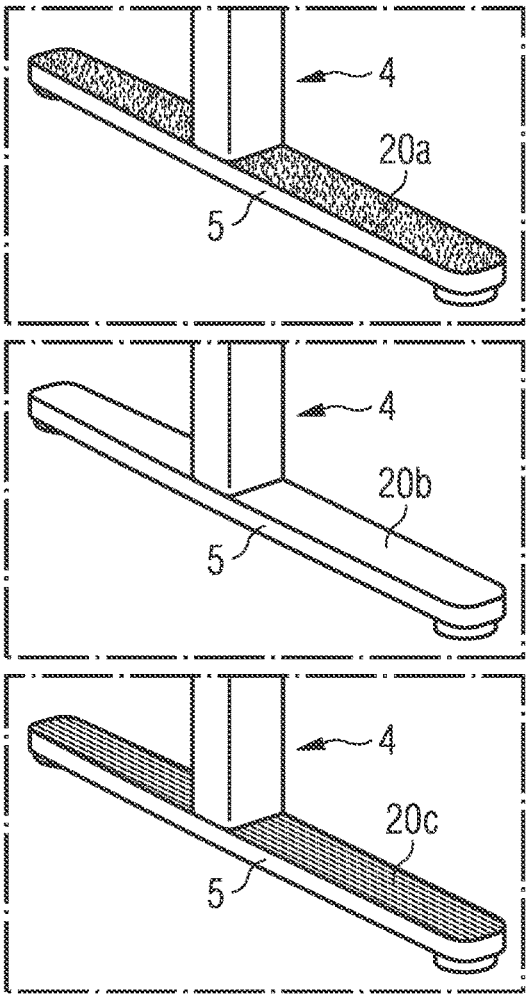

FIGS. 6*a* and 6*b* show embodiments of components of a leg 4 according to the present disclosure for use on or in a worktable 1 of the type explained above. FIG. 6*a* shows a base 5 of a corresponding leg 4, as it can be designed, for example, according to the type explained above. One or more decorative elements 20*a* to 20*c* can alternatively be arranged on the base 5. Each decorative element 20*a* to 20*c* has an areal main dimension and is fixed to the base 5 in such a way that the respective decorative element 20*a* to 20*c* extends along its areal main dimension along part of the surface of the base 5 which is in congruence with the outer dimensions of the respective decorative element 20*a* to 20*c*. A respective decorative element 20*a* to 20*c* may be fixed to the base 5 of the leg via magnetic elements, magnetic foil, adhesive foil, Velcro or similar, for instance.

Each decorative element 20*a* to 20*c* and the base 5 have two centrally arranged openings according to the embodiment in FIG. 6*a*. These are used to screw the base 5 with the decorative element 20*a* to 20*c* arranged in each case to a further part of the leg 4. The further part of the leg 4 may be, for example, a column 6 of the type explained above.

FIG. 6*b* shows three partial views of a part of a leg 4 with the base 5 mounted in each case, wherein a different decorative element 20*a* to 20*c* is fixed to the base 5 according to FIG. 6*a* in each case.

The designs according to FIGS. 6*a* and 6*b* allow varying the leg 4 in relation to its decorative element 20*a* to 20*c*, which can be easily replaced, exchanged or varied. In this way, for example, it is possible to adapt the leg 4 to a surface decor of a table top 2 of the type explained above. This means that the overall aesthetic appearance of a worktable 1 of the type explained above can also be varied or adapted. A decorative element 20*a* to 20*c*, for example, can also be easily replaced if it is damaged. In this way it is easy to repair or restore the base without having to replace the base 5 and/or a column 6 of the leg 4 or the entire leg 4 or even the entire worktable 1 including table top 2. In this way, the adaptability of the leg 4 according to the characteristics of FIGS. 6*a* and 6*b* works synergistically with another adaptable or variable functionality of a leg 4 or a worktable 1 as described above.

In embodiments alternative to those of FIGS. 6*a* and 6*b*, several decorative elements can be arranged simultaneously at the base 5 of leg 4 instead of one decorative element 20*a* to 20*c*. For example, two decorative elements may be provided which are arranged on the surface of base 5 on opposite sides of column 6, so that the column 6 is surrounded by the two decorative elements on base 5. Such alternative embodiments have the advantage that the base 5 does not have to be removed from the column 6 in order to remove a decorative element from the base 5. Rather, a decorative element can be advantageously designed to be completely free of openings. Such a decorative element can be attached to the base 5 without screws.

FIGS. 7*a* to 7*d* show an embodiment of a system 21 with a worktable and a packaging. For example, the worktable may be designed as described above. The packaging forms a kind of smart or intelligent packaging for space-saving and safe storage of all components of the worktable combined with simple assembly and disassembly of all components.

Figure 7A:
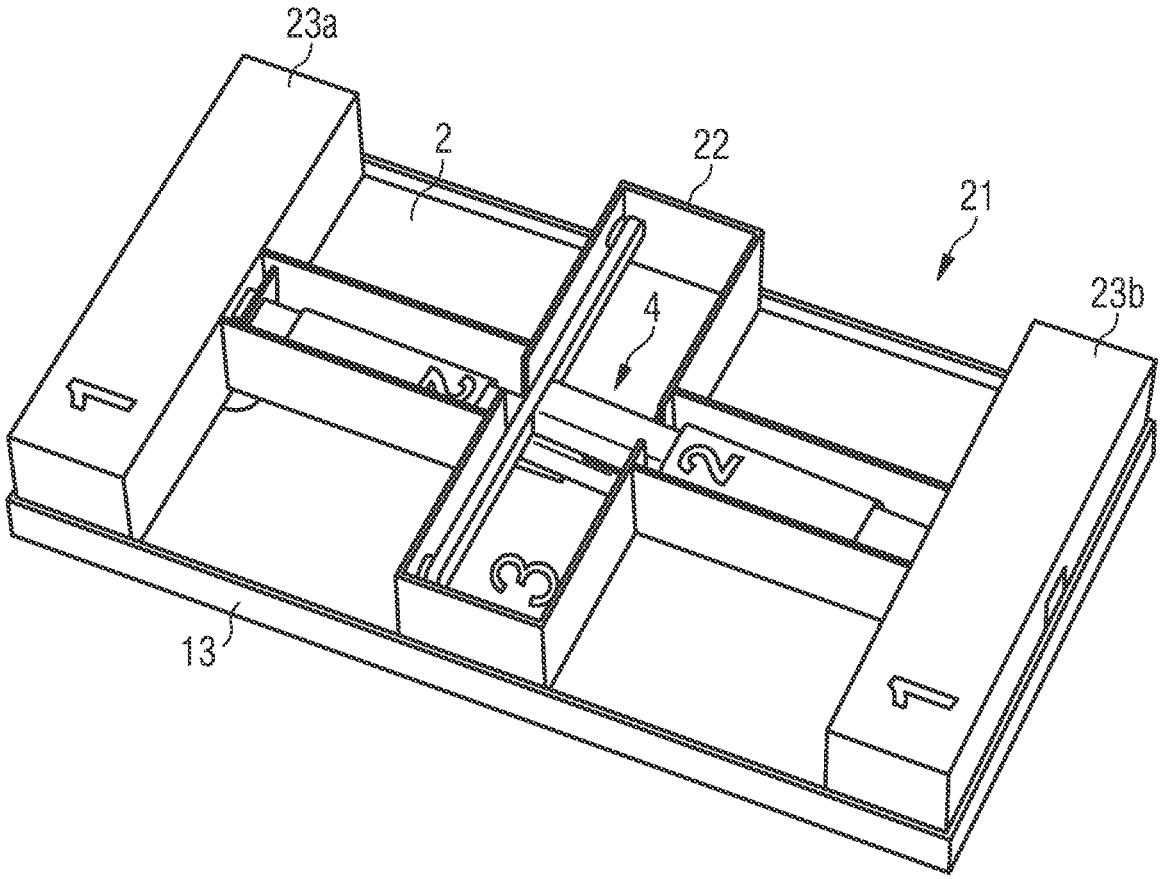
FIG. 7*a* is a perspective view of an embodiment of a system according to the present disclosure of a worktable with a packaging in a first state.

FIG. 7*a* shows the system 21 in a first state. In this state, an overpack is opened in such a way that the individual components of the worktable are accessible except for a lower overpack element 13. The table top 2 of the worktable is received in the overpack element 13 and is protected by it as the assembly of the worktable progresses. The worktable has two legs 4 according to the embodiment in FIG. 7*a*, with the legs 4 being oriented with respect to the table top 2 as according to the embodiment in FIG. 4*b*. The legs 4 may be arranged according to the type explained above.

Figure 7B:
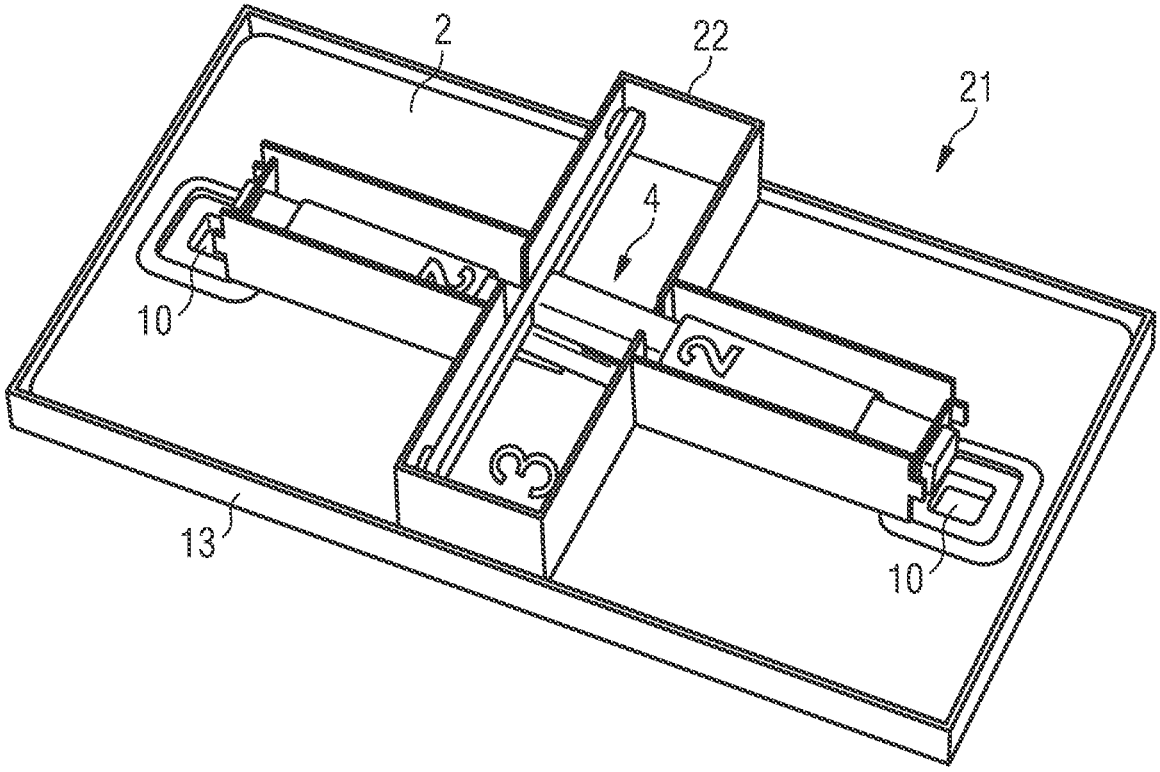
FIG. 7*b* shows the system according to FIG. 7*a* in a second state.

The legs 4 are surrounded or enclosed by one or more first packaging elements 22. In the embodiment of the system 21 according to FIG. 7*a*, the first packaging elements 22 are cross-shaped and thus surround the superimposed T-shaped legs 4 from all sides. Further areas of the table top 2 are covered by second packaging elements 23*a* and 23*b*. A user can remove the second packaging elements 23*a* and 23*b* from the overpack element 13, as shown in FIG. 7*b*. Markings or numberings on packaging elements 22, 23*a*, 23*b* or on other elements attached to the legs 4 indicate to the user the sequence of the individual assembly steps. In this way, the intelligent packaging not only includes stable and safe storage of the individual components of the worktable, but also guides the user through the individual assembly steps to assemble the worktable based on the shape and arrangement of the individual packaging elements 22, 23*a*, 23*b*. For example, a number 1 on each of the packaging elements 23*a* and 23*b* according to FIG. 7*a* indicates to a user that he must remove these two packaging elements 23*a* and 23*b* in a first step.

According to FIG. 7*b*, which shows a second state of system 21, the second packaging elements 23*a* and 23*b* are removed so that mounting openings 10 in the table top 2 are exposed. The mounting openings 10 can be arranged as described above. In the state as shown in FIG. 7*b*, the two legs 4 are still enclosed by the first packaging elements 21 and are still held in a stable and secure way.

Figure 7C:
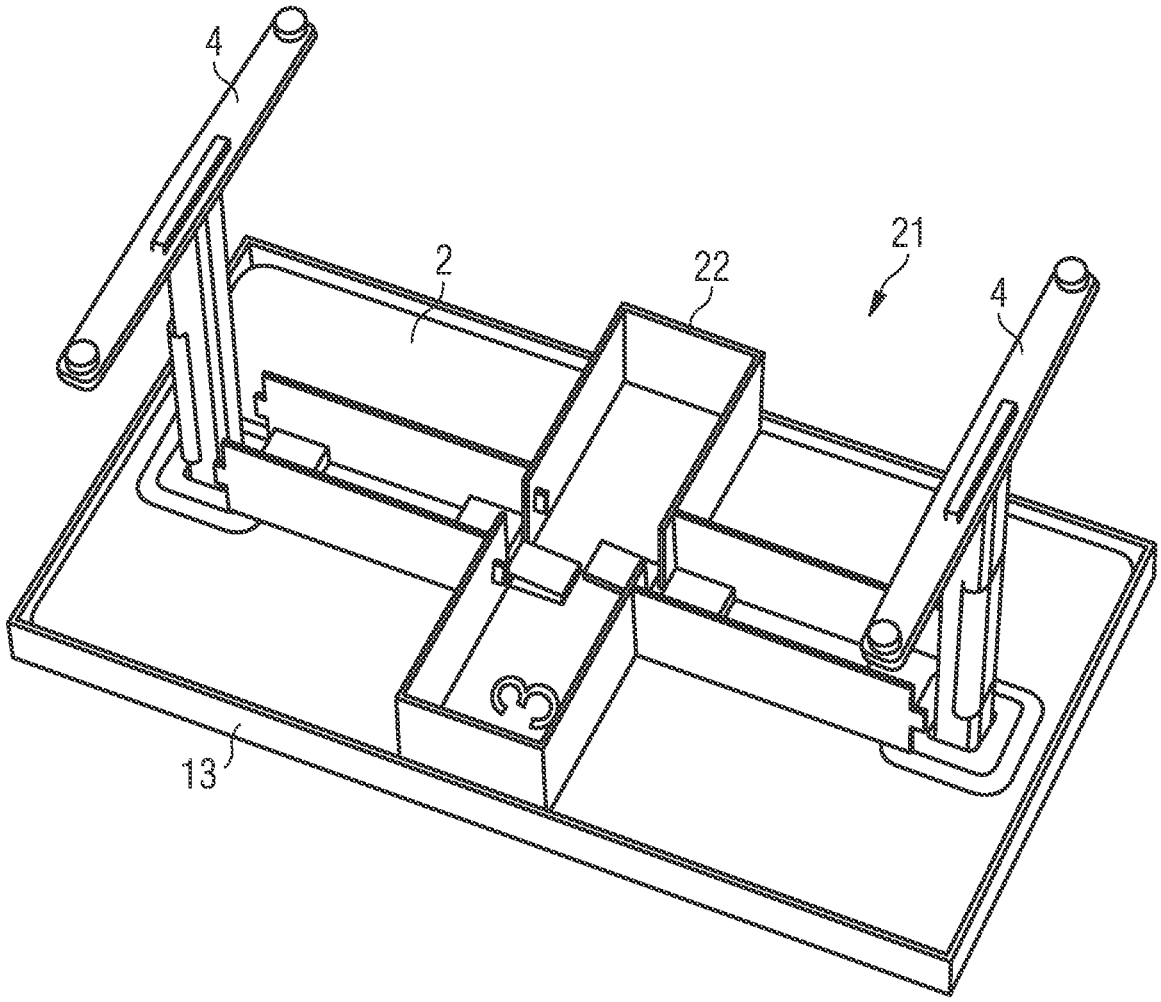
FIG. 7*c* shows the system according to FIG. 7*a* in a third state.

Supported by the packaging concept of system 21, the user can then swing the two legs 4 upwards from the illustrated position starting from the state according to FIG. 7*b* so that they are positioned perpendicular to the table top 2 in accordance with FIG. 7*c* and engage in the mounting openings 10 (see FIG. 7*b*). The legs 4 can be fixed in the mounting openings 10, e.g., screwed in tight. In this respect, reference is made to the above explanations, e.g., to the embodiments shown in FIGS. 4*a* and 4*b*. After carrying out the appropriate assembly steps for mounting the legs 4 according to FIG. 7*c* on the table top 2, the packaging elements 22 can finally be removed so that the table with the table top 2 and the legs 4 mounted thereon is fully assembled according to the state in FIG. 7*d*. Finally, a user only has to lift the table out of the overpack element 13 by the table top 2 and place it on a support surface, turned by 180°. In this way, a worktable 1 can be built up, for example, according to the embodiment in FIG. 1.

Figure 7D:
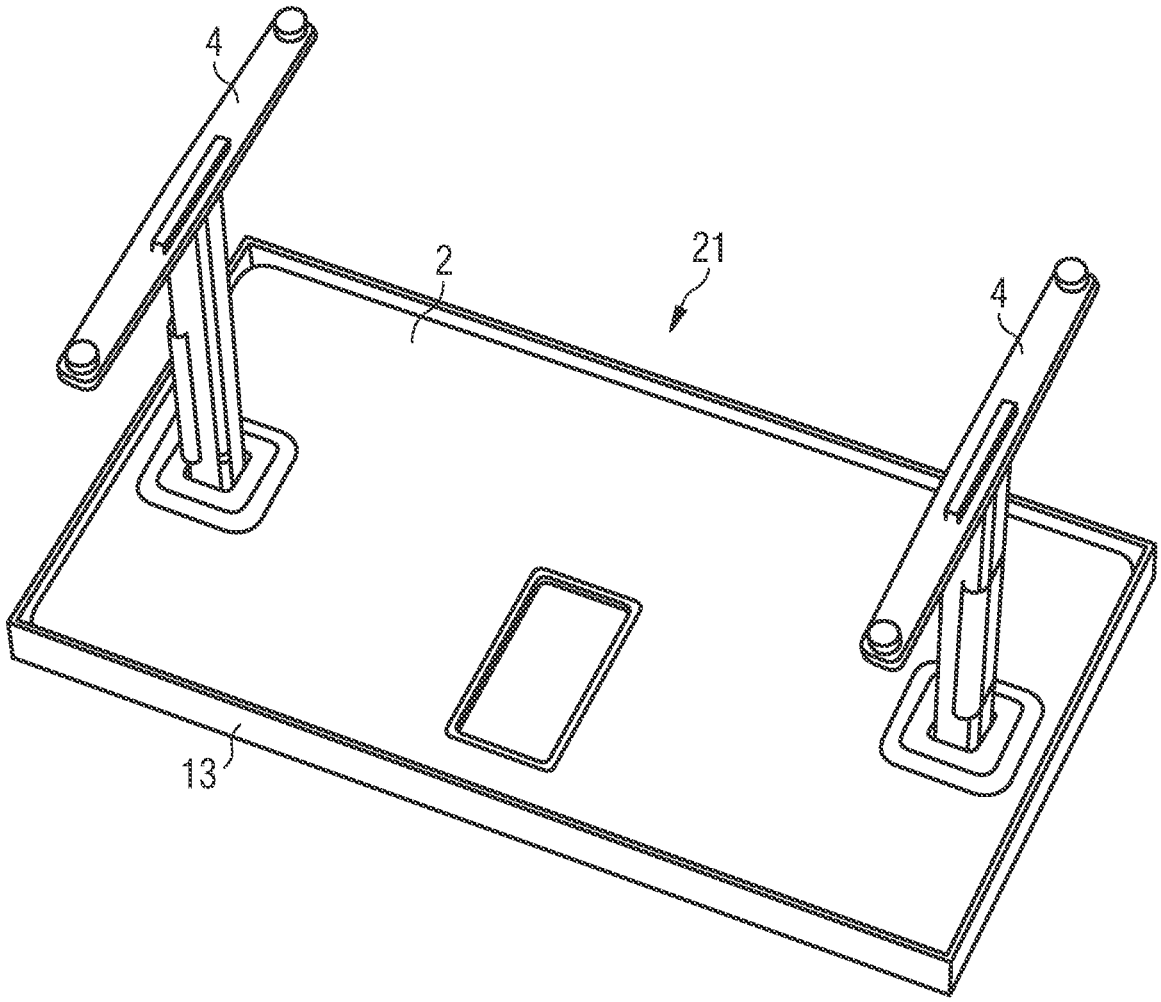
FIG. 7*d* shows the system according to FIG. 7*a* in a fourth state.

The corresponding dismantling of a worktable for packing, e.g., for transport or storage, is carried out in analogy by reversing the steps and measures starting with FIG. 7*d* and processing to FIG. 7*a*.

A system 21 with an intelligent packaging, as explained for FIGS. 7*a* to 7*d*, allows safe storage and transport of the worktable in a dismantled state, wherein the worktable is accommodated in a very space-saving manner. For example, the worktable can be packed this way in a single package and delivered to an end customer. For example, such a package may have maximum dimensions of 150×80×25 cm. The weight of the worktable can be kept below 30 kg so that a package can be produced which can be handled relatively easily also against this background. In this way, a "handy" package is realized. Also a storage of the worktable in the disassembled state, packed in the system 21, can take place this way in a space-saving and thus storage cost-saving manner. This is particularly advantageous for open-plan offices or companies with a large number of such worktables, if not all worktables are constantly in use. The system 21's intelligent packaging guides the customer through the individual assembly steps of the worktable during unpacking, as explained. For example, the ability of folding the legs 4, as explained above, is supported or highlighted by this.

A system 21 according to FIGS. 7*a* to 7*d* can alternatively be applied to legs 4 which are dismantled according to FIG. 4*a*. In this design, appropriate packaging elements 22 or 23*a* and 23*b* may have to be adapted perhaps in order to enclose and package the individual parts 5, 6 of the leg. By analogy with FIGS. 7*a* to 7*d*, the design and positioning of the packaging elements 22 or 23*a* and 23*b* specify the individual assembly steps for unpacking and assembling the individual parts in this configuration as well.

The aspects of a table top, a leg and an entire worktable with a table top and legs, as well as a corresponding packaging system or concept, which have been explained in this disclosure, enable the synergetic interaction of all the advantages and advantageous aspects explained, which follow a systematic approach to improve a worktable in order to harmonize a functionality or functional scope of the worktable with safe, flexible and simple handling in any operating or application situation. In this way, the worktable and its components described here form an integral, comprehensive and system-oriented functionality, e.g., due to the aspects of height adjustment, the foldability of the legs and the adaptability to different functionalities, realized by the special structure of the table top or legs. All these aspects work together synergistically to create a worktable with its components which is improved compared to conventional solutions. Thanks to a system explained here, including such a worktable and an intelligent packaging, the worktable can be packed, stowed, assembled and disassembled in a space-saving, simple and safe manner.

What is claimed is:

1. A worktable comprising:

a table top comprising:

a honeycomb structure extending along a main extension plane of the table top; and one or more cut out areas cut out from the honeycomb structure in accordance with a predetermined layout for accommodating electrical and/or mechanical components; and legs, wherein the worktable is electrically height-adjustable and one or more control components for controlling an electrical height adjustment are embedded in the one or more cut out areas.

2. The worktable according to claim 1, wherein the one or more control components include an electrical safety device configured to enable or disable the electrical height adjustment, wherein the electrical safety device has a contact element for cooperating with a mating contact element for enabling or disabling the electrical height adjustment.

3. The worktable according to claim 1, wherein electric drives configured to adjust a height are integrated in the legs allowing an extension length of the legs in a height direction to be changed, wherein the electric drives are connected via one or more cables to the one or more control components, and wherein a retraction mechanism is integrated into the table top or into the legs, the retraction mechanism configured to pull in the one or more cables of the electric drives when the legs are brought from a first assembly state into a second assembly state.

4. The worktable according to claim 1, wherein the legs or parts of the legs are variably adjustable in their orientation relative to the main extension plane of the table top, wherein, in a first assembly state, the legs or parts of the legs are adjustable parallel or almost parallel to the main extension plane of the table top, wherein, in a second assembly state, the legs or parts of the legs are adjustable perpendicularly to the main extension plane of the table top and are fixable with respect to the table top in this position, and wherein the worktable is configured to change between the first assembly state and the second assembly state.

5. A system comprising:

a worktable comprising:

a table top; and legs; and a packaging, wherein the table top has mounting openings for receiving the legs or pails of the legs in a mounted position of the legs perpendicular to a main extension plane of the table top, wherein the legs or the parts of the legs are stored so as to be parallel or almost parallel to the main extension plane of the table top in a dismounted position of the legs, and wherein the legs or the parts of the legs are held in the dismounted position by one or more first packaging elements of the packaging which at least partially encloses the legs or the parts of the legs, wherein the mounting openings in the table top are concealed by one or more second packaging elements of the packaging, and wherein the table top, the legs or the parts of the legs, and the first and second packaging elements are at least partially enclosed by one or more overpack elements of the packaging.

6. The worktable according to claim 1, wherein the table top comprises two panel elements spaced apart from each other in a thickness direction perpendicular to the main extension plane of the table top, and wherein the honeycomb structure is arranged between the two panel elements.

* * * * *